US005167732A

United States Patent [19]

Naik

[11] Patent Number: 5,167,732

[45] Date of Patent: Dec. 1, 1992

[54] NICKEL ALUMINIDE BASE SINGLE CRYSTAL ALLOYS

[75] Inventor: Subhash K. Naik, Milford, Conn.

[73] Assignee: Textron, Inc., Providence, R.I.

[21] Appl. No.: 770,631

[22] Filed: Oct. 3, 1991

[51] Int. Cl.[5] ..... C22C 19/03

[52] U.S. Cl. ..... 148/404; 420/460

[58] Field of Search ..... 148/409, 404, 410, 428, 148/429; 420/460

[56] References Cited

U.S. PATENT DOCUMENTS 4,801,513 1/1989 Duhl et al. ..... 148/404

*Primary Examiner*—R. Dean
*Assistant Examiner*—M. Phipps
*Attorney, Agent, or Firm*—Perman & Green

[57] ABSTRACT

Nickel aluminide single crystal alloys having improved strength and ductility at elevated temperatures, produced by major elemental additions to strengthen the $Ni_3Al$ phase by solid solutioning and/or secondary phase formation. The major elemental additions comprise (by weight) 7-20% Al, 0.5-9% molybedenum, 0.5-10% tungsten and 2-15% titanium. Optional minor elemental additions of boron, manganese, silcon and/or hafnium are preferred.

5 Claims, 2 Drawing Sheets

NICKEL ALUMINIDE BASE SINGLE CRYSTAL ALLOYS

BACKGROUND OF THE INVENTION

1. Field of the Invention

The present invention relates to improved nickel aluminide single crystal base alloy compositions having superior tensile strength and stress-rupture strength and capable of being wrought or cast into shape by single crystal casting technology at a high or standard solidification rate.

Single crystal nickel aluminide alloys of different compositions are well known as proposed substitutes for single crystal nickel chromium alloys, or stainless steels, in the event that chromium becomes unavailable.

Nickel aluminide can be cast as single crystal $Ni_3Al$, or can exist as polycrystalline nickel aluminide. The $Ni_3Al$ phase is brittle and drops in strength above about 1400° F. The ductility of $Ni_3Al$ has been improved by the minor addition of boron. However, greater improvements in strength and ductibility at elevated temperatures, up to about 1600° F., are necessary to permit the use of modified $Ni_3Al$ alloys for higher temperature applications.

2. Description of the Prior Art

It has been proposed to alter the properties of nickel aluminide alloys by the addition thereto of various ingredients.

U.S. Pat. No. 4,677,035 discloses high strength nickel base single crystal alloy compositions having high stress-rupture strength at elevated temperatures, such as 1800° F./20 ksi for 1000 hours. Such compositions contain relatively high amounts of chromium and cobalt, have unsatisfactory stress rupture strength at low temperatures and have unsatisfactory oxidation resistance and corrosion resistance.

U.S. Pat. No. 4,885,216 discloses improved nickel base alloy compositions having similar high temperature stress-rupture strength properties as the alloys of U.S. Pat. No. 4,677,035 but having improved oxidation resistance and corrosion resistance due to the incorporation of small amounts of hafnium and/or silicon and optional small amounts of yttrium, lanthanum and/or manganese. However the alloys of this Patent also have unsatisfactory stress-rupture strength at low temperatures U.S. Pat. No. 4,612,164 discloses the inclusion of boron, hafnium and/or zirconium in nickel aluminide alloys to improve ductility and yield strength up to about 133 ksi at elevated temperatures up to about 850° C. (1562° F). The addition of titanium, molybdenum and/or tungsten is not suggested.

U.S. Pat. No. 4,711,761 issued on an application referred to in U.S. Pat. No. 4,612,165, and discloses $Ni_3Al$ alloys to which manganese, niobium and titanium are added to improve fabricability. The nickel aluminide alloys are doped with boron and a substantial weight of iron, but the amount of titanium is only 0.5 weight percent. Such iron-containing compositions have limited tensile strength and temperature capabilities.

U.S. Pat. No. 4,478,791 discloses the addition of boron to nickel aluminide alloys to improve the strength and ductility thereof, and U.S. Pat. No. 4,613,489 discloses that the loss of ductility of such cast composition during annealing can be avoided by subjecting them to hot isostatic pressing. Compositions containing specific amounts of titanium, molybdenum and/or tungsten are not disclosed.

U.S. Pat. No. 3,933,483 discloses the addition of at least 10% by weight molybdenum and up to 2.5% by weight of silicon to nickel aluminides in order to increase the tensile strength at elevated temperatures and the toughness at room temperatures without impairing the oxidation-resistance thereof. The addition of tungsten and/or titanium is not disclosed, and silicon is a melting point depressant.

Related U.S. Pat. No. 3,904,403 further discloses the addition of titanium, chromium, zirconium, niobium, tantalum or tungsten to silicon-containing nickel aluminide alloys. No compositions containing molybdenum, tungsten and titanium are disclosed.

Other prior art patents of interest include U.S. Pat. No. 4,461,751 and 2,542,962.

SUMMARY OF THE INVENTION

Figure 1A:
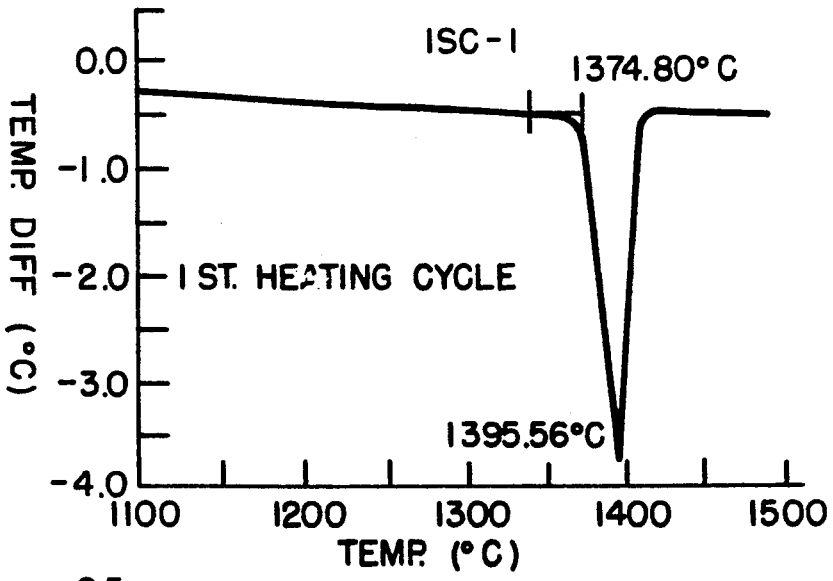
FIG. 1A. (PRIOR ART)
FIG. 1(*c*) shows the DTA curve of a preferred alloy ISC-5 of the present invention as compared to the DTA curves for control base alloys ISC-1, ISC-3 and ISC-6 shown in FIGS. 1(*a*), 1 (*b*), and 1 (*d*) respectively.
Figure 1B:
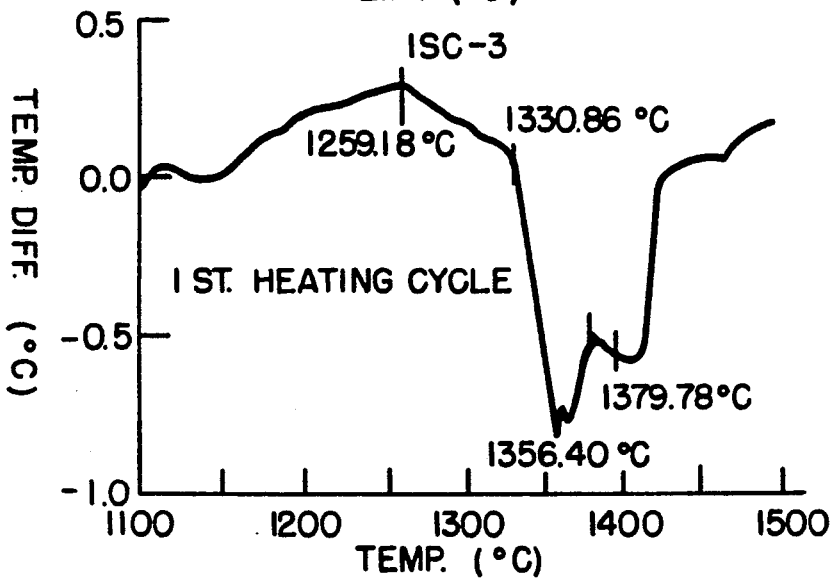
Figure 1C:
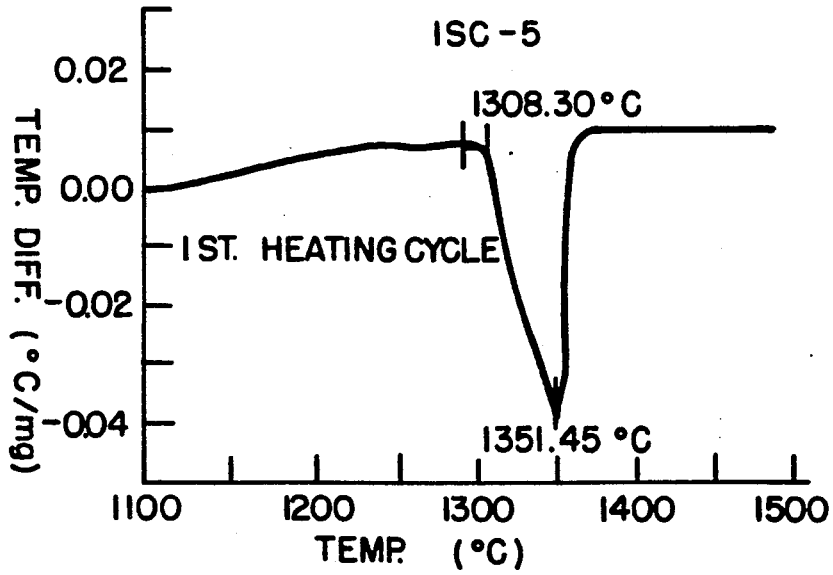
Figure 1D:
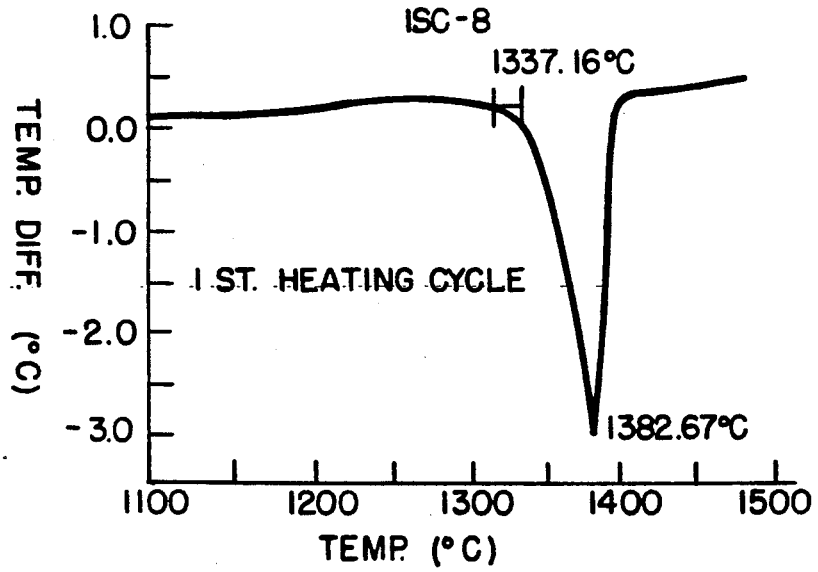
FIG. 1D. (PRIOR ART)

The object of this invention is to provide a modified nickel aluminide base single crystal intermetallic alloy of superior tensile strength and stress-rupture strength, at temperatures ranging between room temperature up to about 1600° F. and good corrosion resistance and oxidation resistance. The present alloys can be wrought or cast into useful shapes, as for gas turbine engine components. The present alloys may be easily cast in an equiaxed form, or may be cast at standard or high solidification rates in single crystal form for particular utility as power turbine blades in a gas turbine engine.

According to the embodiments of the present invention, fibers or whiskers or fabrics thereof can be incorporated into the present alloys to form a metal matrix composite, further enhancing suitability for fabricating highly stressed rotating components such as turbine blades.

The foregoing objects, and others, are accomplished by providing a novel nickel aluminide based alloy composition comprising by weight about:

| | BROAD RANGE | MORE PREFERRED | MOST PREFERRED |
|---|---|---|---|
| aluminum | 7.0%–20.0% | 7.0–15% | 8.0–12.0% |
| molybdenum | 0.5%–9.0% | 1.0–8.0% | 5.0–7.0% |
| tungsten | 0.5%–10.0% | 1.0–8.0% | 5.0–7.0% |
| titanium | 2.0%–15.0% | 3.0–8.0% | 4.0–6.0% |
| boron | 0%–0.2% | 0–0.1% | — |
| manganese | 0%–0.5% | 0–0.05% | — |
| silicon | 0%–0.5% | 0–0.15% | — |
| hafnium | 0%–0.5% | 0–0.2% | — |
| | bal. nickel | bal. nickel | bal. nickel |

Currently, turbine blades capable of operating at the highest temperatures are cast in single crystal form. Compared to polycrystalline material, the elimination of grain boundaries enhances creep resistance, a primary requirement for high temperature turbine blades. The alloys heretofore known and commonly used for casting into single crystal blades have been primarily nickel base. In the heretofore known alloys, the ductile gamma phase is strengthened by dispersing throughout it a harder, more brittle gamma prime phase, the tri-nickel aluminide ($Ni_3Al$).

On the binary nickel-aluminum system phase diagram, the tri-nickel aluminide is denoted as the gamma prime phase, and is found to occur in a small range of aluminum contents between 23.0 and 27.5 atomic percent, or 13.6 and 14.0 weight percent.

With the matrix of the known control alloys based on the gamma prime phase, the ultimate strength of such alloys is limited by the weakness of the gamma prime phase. The approach in the current invention is to employ a matrix of predominantly trinickel aluminide, which heretofore has suffered from poor ductility and low strength, and to improve its properties through solid solution and/or additional phases being present. This disadvantage has been lessened to some extent, according to U.S. Pat. Nos. 4,612,165 and 4,711,761, by minor additions of other elements such as iron, boron or manganese. According to the present invention, the solid solution strength of the base matrix is substantially increased by additions of molybdenum, titanium and tungsten. Furthermore in the investigation of alloys encompassed by this invention, the effect of replacing aluminum with titanium was determined. Trinickel aluminide and metastable trinickel titaniumide produce an isomorphus structure in the compositions of the present invention.

The following compositions were prepared in the evaluation of the present invention, as listed in Table I below. Eight of the compositions were formed into single crystal test specimens. Listed in Tables 2 and 3 are the density, x-ray diffraction results and the incipient melting temperatures as determined for these latter eight compositions.

TABLE 1

NOMINAL COMPOSITIONS (WT %) OF CANDIDATE INTER-METALLIC SINGLE CRYSTAL (ISC) ALLOYS

| Alloy Designation | Composition |
|---|---|
| ISC-1 | Ni—14Al (control) |
| ISC-2 | Ni—12.8AL—6.8Mo—6.8W |
| ISC-3 | Ni—13.8Al—6.8Mo—6.8W |
| ISC-4 | Ni—7.2Al—10.2Ti—6.8Mo—6.8W |
| ISC-5 | Ni—10.2Al—5.2Ti—6.8Mo—6.8W |
| ISC-6 | Ni—14Al—0.1B (control) |
| ISC-7 | Ni—12.8Al—6.8Mo—6.8W—0.1B |
| ISC-8 | Ni—13.8Al—6.8Mo—6.8W—0.1B |
| ISC-9 | Ni—7.2Al—10.2Ti—6.8Mo—6.8W—0.1B |
| ISC-10 | Ni—10.2Al—5.2Ti—6.8Mo—6.8W—0.1B |

TABLE 2

DENSITY AND X-RAY ANALYSIS OF ISC-X ALLOYS

| Alloy | Density (lb./in.$^3$) | XRD Analysis |
|---|---|---|
| ISC-1 | 0.268 | $Ni_3Al$, NiAl (control) |
| ISC-2 | 0.283 | $Ni_3Al$, W(Mo) |
| ISC-3 | 0.280 | $Ni_3Al$, NiAl, W(Mo) |
| ISC-4 | 0.287 | $Ni_3Al$, NiAl, W(Mo), $Ni_3Ti$ |
| ISC-5 | 0.288 | $Ni_3Al$, NiAl, W(Mo) |
| ISC-6 | 0.266 | $Ni_3Al$, NiAl (control) |
| ISC-8 | 0.284 | $Ni_3Al$, NiAl, W(Mo), $W_2B$ |
| ISC-10 | 0.286 | $Ni_3Al$, NiAl, W(Mo), $W_2B$ |

TABLE 3

DTA SUMMARY OF ISC-X ALLOYS

| Alloy | Incipient Melt Temperature (°F.) |
|---|---|
| ISC-1 (control) | 2505 |
| ISC-2 | 2409 |
| ISC-3 | 2427 |
| ISC-4 | 2328 |
| ISC-5 | 2386 |
| ISC-6 (control) | 2438 |

The x-ray diffraction analysis indicates that the alloys consist of two to four phases. Comparing alloys No. ISC-2 and -3, the slightly higher aluminum content of alloy No. ISC-3 results in the presence of the NiAl phase. Interestingly, a titanium content of 5.8% as in alloy No. ISC-5 does not result in the presence of the $Ni_3Ti$ phase which appears in alloy No. ISC-4 which has a higher titanium content. The boron additions of 0.1% in alloys No. ISC-6 through 10 were much larger than the 100 to 400 ppm by weight used by Oak Ridge National Laboratories (ORNL Baseline in FIG. 2). The larger additions of boron were to investigate the effects of larger boron content on ductility. It was also believed that the low levels of boron would increase production cost in that more exact control would be required. However, the inclusion of boron in alloy NO ISC-6, in the absence of molybdenum and tungsten, was found to reduce the stress-rupture or yield strength to unacceptable levels at room temperature, as shown in Table 4.

The object is to develop compositions which exhibit higher tensile strength capability (from RT to 1600° F.) over known $Ni_3Al$ alloy compositions.

Table 1 lists the alloy designations along with their nominal compositions. Briefly, ISC-1 is the known baseline alloy and ISC-2 to ISC-5 are alloys with major additions of Mo and W, with and without Ti. The intent was twofold: (1) identify the solid solubility limit of W and Mo in the $Ni_3Al$ phase in an effort to strengthen the phase through solid solutioning and/or secondary phase formation; and (2) determine the effects of substituting Ti for Al in the ordered NiAl phase. Alloys ISC-6 to -10 are similar compositions as -1 to -5; however, 0.1 percent B was added to verify if ductility could be improved.

As shown by Table 2, the density of the baseline $Ni_3Al$ (ISC-1) is 0.268 lb/in.$^3$ while densities for modified chemistry alloys (ISC 2-5) range from 0.280 to 0.288 lb/cu in. Since the density of nickel base single crystal alloys produced according to our aforementioned U.S. Pat. No. 4,677,035 is 0.312, it can be concluded that the present intermetallic single crystal alloys have 8 to 16 percent lower density than the prior known nickel base single crystal alloys. XRD analysis indicates that the candidate alloys consist of two to four phases. Comparison of XRD results for ISC-2 and -3 indicate that for the same W, and Mo content, the higher Al content (13.8 2t% A, ISC-3) results in the NiAl phase A lower Al content (i.e., 12.2 to 12.8 wt% Al) if only the $Ni_3Al$ phase is desired. A titanium content of 5.8 wt. % does not result in $Ni_3Ti$ phase (e.g. see ISC-5) while larger Ti contents (10.2 wt. % in ISC-4) result in a separate $Ni_3Ti$ phase. The boron additions (0.1%) in ISC-6 to -10 were much larger than those used by ORNL (100 to 400 ppm). This was done to verify the effects of large boron contents on ductility. It was also felt that low levels of boron would in turn increase alloy procurement cost, due to the stricter controls required during production. Therefore, the intent was to identify the upper limits of boron required for improved ductility while easing the specification requirements. The XRD analysis indicated that 0.1 wt. % B would form the $W_2B$ phase.

DTA studies were conducted to determine the melt temperature of the tested alloys. FIG. 1 shows typical DTA curves of alloys ISC -1, -3, -5 and -6. Table 3 lists the incipient melt temperatures of ISC-1 to -6 alloys. The baseline or control alloy (ISC-1) indicated the highest incipient melt temperature of about 2505° F. The incipient melt temperature of the modified composition alloys ranged from 2386° F. to 2427° F. while the other control composition, ISC-6, had the second highest melt temperature of 2438° F. Titanium addition has a severe effect on lowering incipient melt temperatures (>120° F.). Also, as expected, the addition of 0.1B lowers the incipient melt temperatures of ISC-1 by about 65° F.

Based on DTA studies, alloys were solution heat treated to verify if any solutioning or change in microstructure could potentially occur. There was more ordered dendritic type phase distribution after heat treatment. The strength properties in the as-cast and heat treated condition alloys were determined to evaluate performance. Table 4 summarizes the tensile results (UTS, Y.S. Elongation, R/A) of various alloys ISC 1-3, -5, -6 and -8 from RT to 1600° F. The tensile strength peaks around 1100° F., as expected. It should be noted that ISC-1 alloy corresponds very closely to the ORNL developed $NI_3Al$ alloy. Comparing data between various alloys, it is clear that alloy ISC-5 shows superior tensile, elongation and R/A properties at both room temperature and elevated temperatures. Alloy ISC-5 exhibits a remarkable 60 percent improvement in strength over the baseline $Ni_3Al$ alloy ISC-1 at all temperatures.

TABLE 4

SUMMARY OF TENSILE DATA FOR ISC-X ALLOYS

| Alloy | Temp. (°F.) | UTS (ksi) | YS (ksi) | Elong. (%) | R/A (%) |
|---|---|---|---|---|---|
| ISC-1 | RT | 63,700 | 44,300 | | 11.6 |
| | 1100 | 97,200 | 76,400 | 4.9 | 10.9 |
| | 1400 | 85,100 | 85,100 | 2.3 | 4.4 |
| | 1600 | 55,600 | 53,800 | | |
| ISC-2 | RT | 87,450 | 71,100 | 1.5 | 4.4 |
| | 1600 | 60,800 | 54,000 | 4.1 | 6.9 |
| ISC-3 | RT | 73,200 | 61,900 | 0.7 | 3.0 |
| | 1100 | 124,400 | 101,300 | 3.9 | 8.0 |
| | 1400 | 83,800 | 74,800 | 8.1 | 14.3 |
| | 1600 | 48,900 | 38,400 | 15.2 | 22.3 |
| ISC-5 | RT | 117,600 | 96,200 | 1.0 | 4.4 |
| | 1100 | 135,200 | 120,700 | 1.3 | 5.1 |
| | 1400 | 119,450 | 114,600 | 0.9 | 4.4 |
| | 1600 | 93,300 | 88,700 | 5.5 | 10.1 |
| ISC-6 | RT | 70,600 | 37,000 | 3.3 | 14.3 |
| | 1100 | 131,900 | 122,000 | 6.6 | 13.0 |
| | 1400 | 121,600 | — | 1.1 | 3.0 |
| | 1600 | 109,400 | 109,400 | 3.5 | 5.9 |
| ISC-8 | RT | 99,500 | 81,500 | 1.1 | 4.4 |
| | 1100 | 125,400 | 106,300 | 2.2 | 5.9 |
| | 1400 | 90,100 | 80,100 | 7.8 | 10.2 |
| | 1600 | 57,000 | 49,300 | 9.8 | 16.4 |

Figure 2:
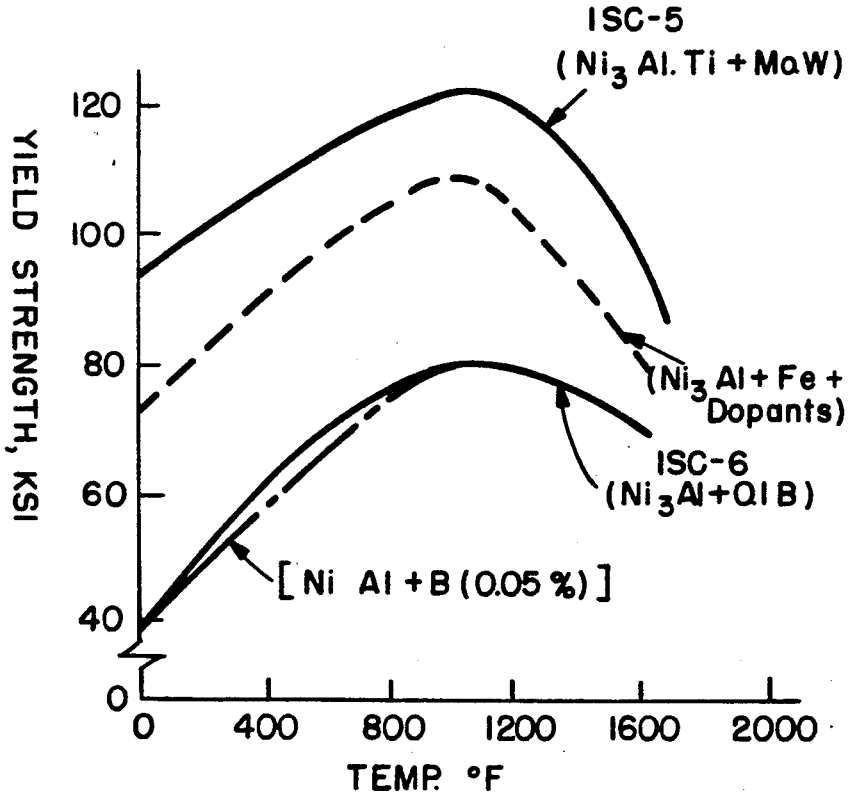
FIG. 2 illustrates the relative yield strengths, over various temperatures, of the present alloy ISC-5 as compared to control base alloys.

FIG. 2 shows the relative performance in yield strengths from RT 31 1600° F. between the present ISC-5 alloy and an advanced alloy (U.S. Pat. No. 4,711,761) developed by ORNL/NASA. The ORNL-/NASA alloy is based on $Ni_3Al$ +FE +Dopants. The baseline alloys (ISC-6 and $NI_3AI$ +0.05% B, also shown in U.S. Pat. No. 4,711,761) have also been included for reference. ISC-5 has 11% higher strength than the best alloy of U.S. Pat. No. 4,711,761.

The results of the S-R testing of the 3 alloys whioh showed the most potential for engine application (for e.g., power turbine blades) are given in Table 5. All alloys exhibited greater than 1000 hour life at 1100° F./65 ksi. However, at higher temperature (e.g., 1200° F./44 ksi), ISC-5 was clearly superior.

TABLE 5

STRESS RUPTURE SUMMARY OF $NI_3AL$ MODIFIED ISC ALLOYS

| Sample Ident. | Temp. (°F.) | Stress (ksi) | Life (hrs) | Elong. (%) | RA (%) |
|---|---|---|---|---|---|
| ISC-3 | 1100 | 65 | 1075.5 | 10.6 | 7.3 |
| ISC-5 | 1100 | 65 | 1007 | Retired | Retired |
| ISC-8 | 1100 | 65 | 1437 | 7.5 | 13.5 |
| ISC-3 | 1200 | 55 | 75 | 7.8 | 6.5 |
| ISC-5 | 1200 | 55 | 1008 | Retired | Retired |
| ISC-8 | 1200 | 55 | 135 | — | 6.5 |
| ISC-5 | 1500 | 25 | 123 | 31.5 | 25 |

The microstructural stability of ISC-5 was considered as excellent, both the as-cast microstructure and the microstructures of ISC-5 S-R tested at 1100° F, 1200° F. and 1500° F. for long time exposures. The oxidation resistance of ISC-5 was superior with no evidence of oxidation attack even on exposures to 1500° F S-R tested bars of ISC-5 evidence excellent oxidation resistance (no oxide layer). Thus the present invention provides $Ni_3Al$ modified SC alloys which show superior performance over prior known $Ni_3Al$ type alloys.

Currently, a high emphasis is placed on light weight, high specific strength titanium aluminide alloys. To date, ($\alpha$-2 $Ti_3Al$ (Ti-25Al-13Nb 1 Mo) and $\alpha$-TiAl (Ti-40Al-lV) with temperature potential of 1100° F. and 1500° F. respectively, have been identified for compressor (for e.g., impeller) and power turbine (for e.g. blades) applications.

ISC-5 has the capability of exceeding the performance of both of these titanium aluminide alloys. Typically the densities of $\alpha$-3 $Ti_3Al$ and $\alpha$-TiAl are 0.17 and 0.14 lbs/cu-in respectively, while ISC-5 has a density of 0.27 lbs/cu-in. The comparative S-R life at 1200° F./55ksi for $\alpha$-2 $Ti_3Al$ and ISC-5, respectively, is 300 hours compared to greater than 1007 hours. It is apparent that ISC-5 has a greater than 2.11X improvement over alpha-2 on a density corrected basis. The comparative yield strength of $\alpha$-TiAl and ISC-5 on a density corrected basis (normalized to TiAl) shows that ISC-5 represents a greater than 30 percent improvement at 1500° F. over $\alpha$-TiAl. Also, based on comparing available literature data (AFWAL-TR-82-4086), ISC-5 exhibits an improvement of over 10 percent in S-R life at 1500° F. when normalized to $\alpha$-TiAl density.

Therefore, ISC-5 alloy is excellent for application in power turbine blades or other light-weight structural component applications. ISC-5 is easily castable to net shape, whereas TiAl has major problems with casting due to its brittleness and cracking problems. Additionally, the as-cast properties of ISC-5 are significantly superior over the complex (e.g., Isoforge +HIP +heat treatment) processed $\alpha$-TiAl. Reduced processing leads to greater cost savings for components fabricated from the ISC-5 alloy.

Preferably the present single crystal alloys are produced as composites containing temperature resistant fibers whiskers or fabrics, such as infiltrated fabrics of single crystal alumina available under the trademark Saphikon. The selection of suitable fibers, whiskers and/or fabrics will be apparent to those skilled in the art in the light of the present disclosure, as will be the processes for producing such composites, such as by investment casting in the withdrawal process.

It is to be understood that the above described embodiments of the invention are illustrative only and that modifications throughout may occur to those skilled in the art. Accordingly, this invention is not to be regarded as limited to the embodiments disclosed herein but is to be limited as defined by the appended claims.

What is claimed is:

1. A nickel aluminide single crystal alloy composition having excellent stress rupture strength and oxidation resistance over a broad temperature range consisting essentially by weight:

about 7.0% to about 20.0% aluminum;
about 0.5% to about 9.0% molybdenum;
about 0.5% to about 10.0% tungsten;
about 2.0% to about 15.0% titanium;
about 0.0% to about 0.2% boron;
about 0.0% to about 0.5% manganese;
about 0.0% to about 0.5% silicon;
about 0.0% to about 0.5% hafnium; and
the balance nickel.

2. An alloy composition according to claim 1 consisting essentially of by weight:

about 7.0% to about 15.0% aluminum;
about 1.0% to about 8.0% molybdenum;
about 1.0% to about 8.0% tungsten;
about 3.0% to about 8.0% titanium;
about 0.0% to about 0.1% boron;
about 0.0% to about 0.05% manganese;
about 0.0% to about 0.15% silicon;
about 0.0% to about 0.2% hafnium; and
the balance nickel.

3. An alloy composition according to claim 1 consisting essentially of by weight:

about 8.0% to about 12.0% aluminum;
about 5.0% to about 7.0% molybdenum;
about 5.0% to about 7.0% tungsten;
about 4.0% to about 6.0% titanium, and
the balance nickel.

4. An article of manufacture comprising material fabricated from the composition of claim 1.

5. An article of manufacture comprising material fabricated from the composition of claim 3.

* * * * *